United States Patent [19]

Heger et al.

[11] 4,112,136

[45] Sep. 5, 1978

[54] METHOD OF MAKING A PATTERN-DYED, PATTERN-TEXTURES, OR LACE LIKE TEXTILE OR FOIL

[75] Inventors: Adolf Heger, Dresden; Gerrit Möckel, Zwickau; Helmar Pässler, Dresden; Jochen Pohlink, Falkenstein; Werner Wünsch, Rodewisch, all of Germany

[73] Assignee: VEB Plauener Gardine, Plauen, Germany

[21] Appl. No.: 539,185

[22] Filed: Dec. 23, 1975

[30] Foreign Application Priority Data

Jan. 7, 1974 [DD] German Democratic Rep. ... 175859

[51] Int. Cl.[2] ..... B05D 3/06

[52] U.S. Cl. ..... 427/36; 427/44; 427/55; 427/56

[58] Field of Search ..... 427/36, 44, 55, 56

[56] References Cited

U.S. PATENT DOCUMENTS

| | | | |
|---|---|---|---|
| 2,955,953 | 10/1960 | Graham | 427/44 |
| 2,956,899 | 10/1960 | Cline | 427/44 |
| 3,097,960 | 7/1963 | Lawton et al. | 427/44 |

*Primary Examiner*—John H. Newsome
*Attorney, Agent, or Firm*—Karl F. Ross

[57] ABSTRACT

A synthetic-resin textile or foil web is printed according to a predetermined pattern with a paste comprising a monomer, prepolymer or polymer. The web is irradiated over its entire surface before printing and only those areas where there is printing paste form high-molecular associations (cross-links, polymerizations, coagulations) so as to pattern the surface of the workpiece. According to the type of associatively-reactable compound used in the printing paste the workpiece will be textured so as to appear sculptured or will be locally colored and textured.

7 Claims, 7 Drawing Figures

METHOD OF MAKING A PATTERN-DYED, PATTERN-TEXTURES, OR LACE LIKE TEXTILE OR FOIL

FIELD OF THE INVENTION

The present invention relates to a method of patterning a web, film, or the like. More particularly this invention relates to the texturing or printing of a textile web.

BACKGROUND OF THE INVENTION

A method is known for structuring, texturing or coloring the surface of a textile web which uses localized irradiation of the surface of the web with energy-carrying rays, to activate or form active sites at locations on the web in association with particular monomers. This results in cross linking.

This localized irradiation of the surface of the web is carried out according to one well-known method by irradiating the web through a template that prevents the rays from falling on those portions of the web which are not to be patterned. Such an arrangement makes it very difficult to produce textures or colored fabrics at high speed, as displacement of the template and/or the source of radiation synchronously with the web is extremely difficult. Thus such a method is only applicable to the stationary treatment of such webs.

It has also been suggested to effect local free-radical formation by means of an electron beam whose intensity is controlled as it scans over the surface of the web. The extremely complicated electronic control system necessary for carrying out this type of scanning considerably raises the cost of the product and also requires that the web move at relatively slow speed so that again production costs are elevated.

These methods all have the disadvantage that they are relatively limited as to their types of application. A further disadvantage of these methods is that none of them allows several different kinds of coagulating or otherwise associatively-reactable compounds to be applied to different areas on the same web in a single operation. Thus it is necessary to employ different steps with different templates and the like to achieve varying effects over a single web. Another disadvantage of the known methods is that a great portion of the associatively-reactable compound is lost, as these are almost invariably applied homogeneously and uniformly over the entire surface of the web and the unused portions are wasted.

OBJECTS OF THE INVENTION

It is therefore an object of the present invention to provide an improved method of treating a web, film, or the like.

Another object is the provision of a method of patterning a web, such as a textile web.

SUMMARY OF THE INVENTION

These objects are attained according to the present invention in a method of patterning a web wherein the entire surface of the web is irradiated uniformly or evenly (homogeneously) with energy-carrying (energetic) radiation. An associatively-reactable compound, by which is meant a monomer, prepolymer or polymer reactive with an activated site, is applied to the web in a predetermined pattern so that a high-molecular association is formed on only those regions of the web to which the associatively-reactable compound is applied.

Thereafter the web is deactivated. The high-molecular association formed can be a cross-link, a polymerization, or a coagulation. According to the present invention the deactivation step is carried out with the use of solid, liquid, and/or gaseous substances, as for example hot air.

In accordance with the present invention, after homogeneous radiation of the web and the application thereto of the associatively-reactable compound, there follows a deactivating treatment of the web with steam, air humidified with water, or an aqueous solution. This step can take place over a period of over 24 hours, depending on the basic material of the web, and can be carried out at a temperature below 120° C.

In accordance with another feature of this invention, following the uniform radiation of the surface of the web with energy-carrying beams as well as the application thereto of the associatively-reactable compounds, but before steam or moist-air treatment, there is effected an intermediate drying. This insures that during the later treatments there will be no smearing or flaking-off of the patterned modifications. This is particularly important in the patterning of a thin textile web, as in thick webs the subsequent treatment does not tend to damage the laid-on pattern. In addition such an intermediate drying allows the use of standard treatment devices. A temperature of below 120° C is advantageously used for this intermediate drying so as to prevent a premature or excessively strong deactivization of the active sites or free radicals formed by the even radiation.

In accordance with another feature of this invention variations in the desired modifications of the patterns are effected by employing different kinds of associatively-reactable compounds in different concentrations.

According to a further feature of the present invention, the application of these associatively-reactable compounds is eased by thickening them with agents such as emulsions or polyacrylates so as to increase their viscosity. Particular thickening agents are mainly easily flowable substances. This considerably facilitates the intermediate drying.

The associatively-reactable compounds, according to a further feature of my present invention, are mixed with hygroscopic substances, such as urea, in order to insure adequate water content, and with coagulating agents, such as for instance sodium sulfate and other electrolytes, to decrease the coagulating time, and certain stabilizers in order to avoid or decrease the homopolymerization by increasing the standing time and the type of high-molecular association formed.

The method according to the present invention allows the production of relatively complicated patterns on a textile web and simultaneously allows various kinds of modifications of this web to be effected. Standard equipment can be used to carry out the method according to the present invention so that production costs are relatively low. In addition it is possible to combine various different kinds of surface modifications such as coloring, texturing, and the like in a single stage, as never has been heretofore possible. The treatment of noncontinuous textiles such as doffer, tulle, net and the like is also possible in accordance with the present invention so as to produce different surface densities to obtain a lace effect. This can be achieved by the localized increase in web density as a result of the high-molecular association whereby, according to the type of substance used, more or less strongly raised surface effects are produced.

BRIEF DESCRIPTION OF THE DRAWING

The above and other objects, features, and advantages will become more readily apparent from the following, reference being made to the accompanying drawing in which.

SPECIFIC DESCRIPTION

Example A

Figure 1:
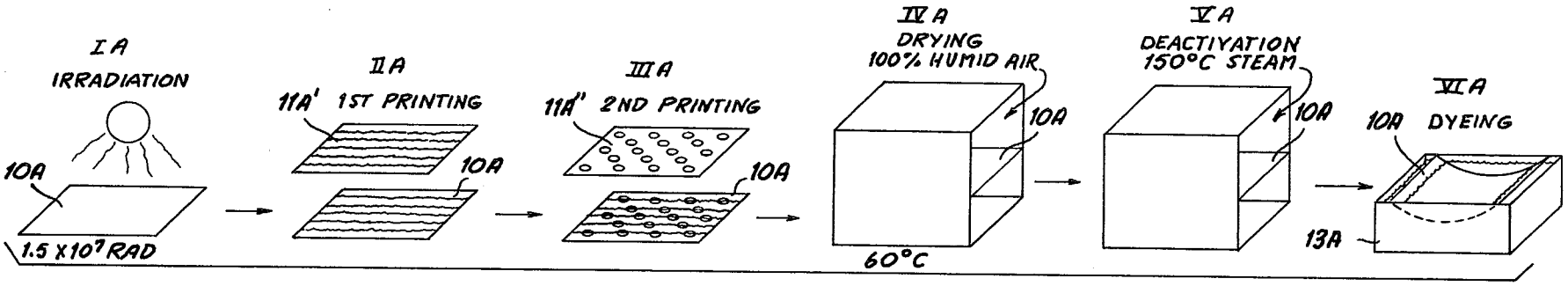
FIGS. 1 – 7 are diagrammatic flow charts illustrating the method according to the present invention.

A warp-knit workpiece 10A is first irradiated as shown in FIG. 1 in a step IA so as evenly to absorb 1.5 $\times 10^7$ rad of radiant energy. Thereafter in step IIA, a first template printer 11A' applies to this workpiece 10A printing paste comprising:

20% by weight (hereinafter all percentages are by weight) acrylamide,
10% sodium sulfate as coagulator,
10% hygroscopic substances and emulsion thickeners concentrated with starch ether, and a homopolymerization stabilizer.

This printer 11A' prints an array of parallel lines on the workpiece 10A. Thereafter a second printer 11A" in a step IIIA applies to the workpiece 10A in a decorative pattern a printing paste comprising:

20% acrylic acid, and A
balance the same as for printer 11A'.

Both printers 11A' and 11A" are of the flat-template type.

Thereafter in step IVA the twice-printed and irradiated workpiece 10A is dried at 60° C for 20 minutes while being subjected to saturated air.

Deactivation subsequently takes place in step VA wherein the workpiece 10A is heated with superheated steam at 150° C.

Finally the workpiece 10A is dyed in step VIA in a vat 13A. The fully treated knit has a surface roughness and a corded appearance as determined by the first printer 11A'. Furthermore, the surface is patterned and colored ornamentally according to the pattern of the second printer 11A". Such a workpiece is ideally usuable for garments and the like.

EXAMPLE B

Figure 2:
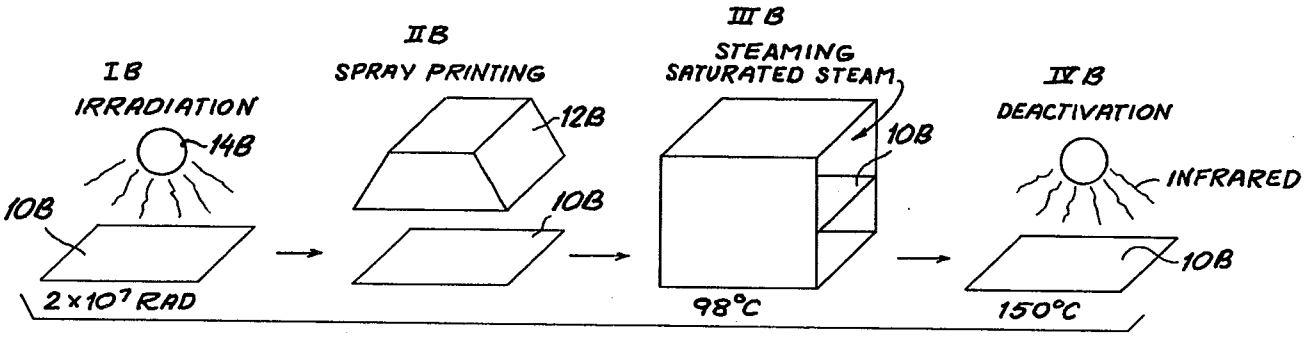

As shown in FIG. 2, a polyamide-silk weft-knit workpiece 10B with a textured pile is first given a dose of $2\times10^7$ rad by an irradiator 14B. Thereafter, the workpiece 10B is printed by a spray printer 12B with a printing paste comprising 25% by weight acrylamide, coagulators, stabilizers, and polyacrylic acid thickeners, according to a predetermined pattern. Immediately thereafter, the workpiece 10B is treated for 30 minutes at 98° C with saturated steam and is subjected subsequently in step IVB to infrared radiation at a temperature of 150° C. The steps IB–IVB follow each other directly. The product is embossed in the workpiece 10B.

EXAMPLE C

Figure 3:
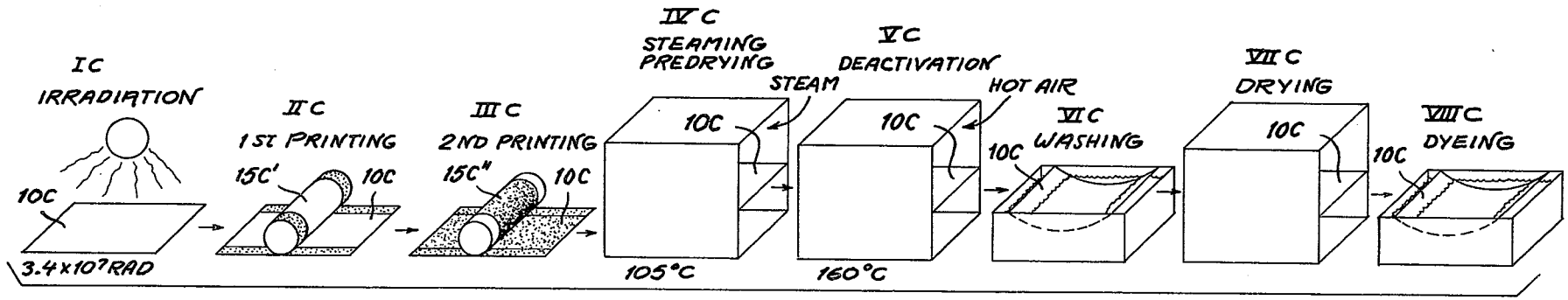

A transparent Raschel-knit workpiece 10C (FIG. 3) of polyester filaments is first given a dose of 3.4 $\times 10^7$ of electron rays. Thereafter it is immediately printed by a first roller-printer 15C' with a printing paste comprising 30% by weight acrylic acid, coagulators, stabilizers, and thickening means. A second roller-printer 15C" applies to the center of the workpiece 10C, whose edges only have been printed by the printer 15C', another printing paste comprising only 10% acrylic acid but otherwise identical to the paste applied by the printer 15C' in the step IIC.

In step IVC the web 10C is steamed and predried at 105° C. Subsequently in step VC the workpiece 10C is deactivated with hot air at 160° C. Thereafter the workpiece 10C is washed in step VIC, dried in step VIIC and dyed in step VIIIC. The resulting product is eminently suitable as curtain material. Use of a basic dyestuff in the step VIIIC creates a tone-on-tone pattern.

EXAMPLE D

Figure 4:
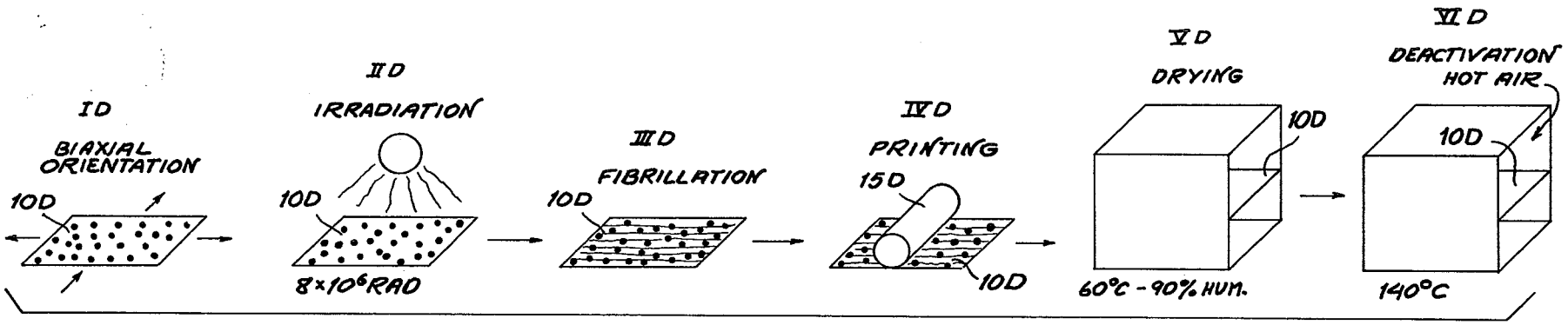

As shown in FIG. 4, a polypropylene-foil workpiece 10D is biaxially stretched in step ID and thereafter irradiated in step IID with a dose of 8 $\times 10^6$ rad of electron radiation. Thereafter the workpiece 10D is fibrillated in step IIID and subsequently is passed through a roller-printer 15D in step IVD twice, the printer 15D first applying a paste having a content of 10% acrylamide, coagulators, hydroscopic substances, stabilizers, emulsion thickeners with starch-ether, and optical clarifiers, then with a second printing paste comprising 30% acrylic acid and a polyacrylic acid as thickener. Both pastes are applied in a very fine raster. Subsequently the workpiece 100 is predried at 60° C for 30 minutes in an atmosphere of 90% relative humidity. Subsequently the web 10D is deactivated in step IVD at 140° C in the presence of hot air. The product so produced is a surface-textured synthetic resin.

EXAMPLE E

Figure 5:
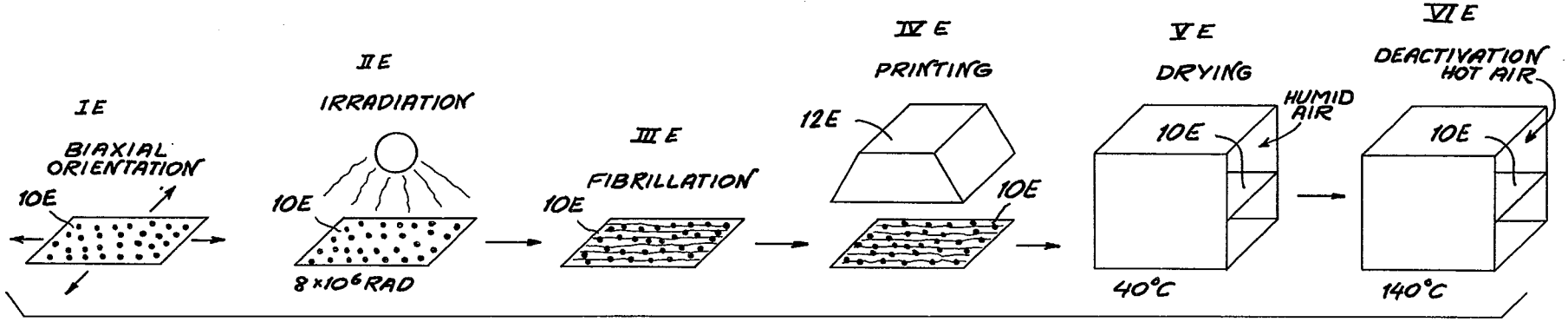

A polypropylene foil workpiece 10E is biaxially oriented, irradiated, and fibrillated as shown in step IE-IIIE in FIG. 5, similarly to the foil 10D in steps ID – IIID of FIG. 4. Thereafter the foil 10E is printed by a spray printer 12E in step IVE on one side only.

In step VE immediately thereafter, the foil 10E is dried for thirty minutes at 40° C in the presence of air of 95% relative humidity. Deactivation takes place in step VIE by means of hot air at a temperature of 140° C. The product has a rough base which can be modified accordingly to the above-given examples.

EXAMPLE F

Figure 6:
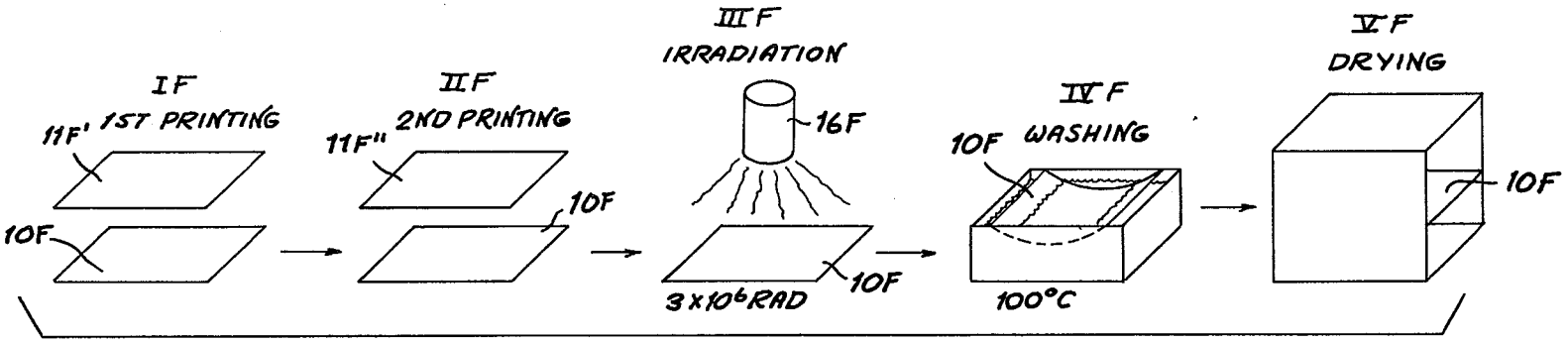

A workpiece web 10F (FIG. 6) formed of a polymer silk flat-warp-knit having a surface density of 100 g/m$^2$ is first printed by a flat-template printer 11F' having 20% acrylamide. Thereafter a second flat-template printer 11F" applies a second paste with a 20% acrylic acid content. In addition both of these pastes contain an emulsion thickener with starch ether.

Thereafter the foil 10F is irradiated with 3 $\times 10^6$ rad by a 300-keV electron accelerator 16F. This irradiation causes the acrylamide and the acrylic acid to polymerize. Thereafter in step IVE the workpiece 10F is washed with water at 100° C so as to remove the printing paste thickener.

In step VF the workpiece 10F is dried so as to produce a locally colored pattern advantageously usable in the production of garments and the like.

EXAMPLE G

Figure 7:
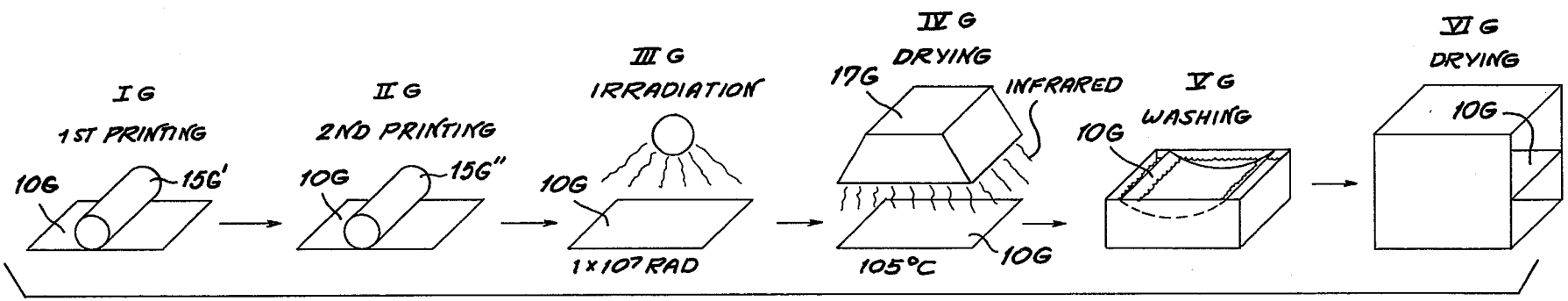

FIG. 7 shows a polyester-knit workpiece web 10G which is first printed by a roller-printer 15G' with a paste having 25% by weight acrylic acid and then in step IIG by a printer 15G'' with a second paste comprising 25% acrylamide, so as to cover 60% of its surface. In addition both of these pastes include fiber-swelling agents, plasticizers, stabilizers, and, as a base, emulsion thickeners with starch ether. The thus treated web 10G is then subjected to electron radiation with a dose of $1 \times 10^7$ rad continuously. Thereafter in step IVG the web 10G is passed under an infrared radiant heater 17G heating it to a temperature of 105° C.

Thereafter the workpiece 10G is washed in a step VG and dried in a step VIG. The finished product has a varying thickness between the treated and untreated regions and is usable as a decoration.

EXAMPLE H

The same basic web as used in Example G is employed, but each of the printing pastes in addition comprise 2% dye, so that in addition to the structural effect of the process, the workpiece is also colored.

In order to carry out the above-described examples before or after the scanner of the electronic accelerator, which is known per se, it is possible to employ devices known in the textile industry. Roller, template, rotating template, and/or spray printers may be used to apply the dye paste. After the high-molecular association is formed by polymerization, cross-linking, or coagulation, the workpiece may be dried by conventional dryers or steamed such as in hanging-curtain steamers. Hot rollers and/or hot air, hot steam, and/or infrared-radiant heaters can be used to dry the workpiece.

We claim:

1. A method of making a uniformly dyed, texture patterned textile web having a lace effect comprising the steps of:

uniformly irradiating the entire surface of said web with energy-carrying radiation corresponding to at least $3 \times 10^6$ rad electron beam energy for activating said web;

applying to said web in a predetermined lace-effect pattern and over less than all of the surface of said web an associatively-reactable compound;

forming a high-molecular association between said compound and the irradiated web to contour-pattern the surface thereof with a lace effect;

deactivating said web by exposure of the web having said contour pattern to steam, hot air or infrared heat at a temperature of 150° C; and thereafter dyeing the deactivated contour pattern web.

2. The method defined in claim 1 wherein said associatively reactable compound is a monomer, a prepolymer, or a polymer.

3. The method defined in claim 2 wherein said web is a polymer.

4. The method defined in claim 3, further comprising the step of predrying said web after irradiation thereof and application thereto of said compound and before deactivation thereof.

5. The method defined in claim 3, further comprising the step of applying to said web in a predetermined second pattern a second associatively-reactable compound having a concentration different from that of the first-mentioned associatively-reactable compound immediately after application of said first compound.

6. The method defined in claim 3 wherein said compound includes a dye.

7. The method defined in claim 3 wherein said compound includes a hygroscopic substance.

* * * * *